US011311792B2

(12) United States Patent
Blunt et al.

(10) Patent No.: US 11,311,792 B2
(45) **Date of Patent: *Apr. 26, 2022**

(54) SHIN GUARD WITH SOCK ENGAGING FEATURE

(71) Applicant: NIKE, Inc., Beaverton, OR (US)

(72) Inventors: Matthew Blunt, Portland, OR (US); Dylan Durrell, Beaverton, OR (US); Kyle Schepke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 244 days.

This patent is subject to a terminal disclaimer.

(21) Appl. No.: 16/671,947

(22) Filed: Nov. 1, 2019

(65) Prior Publication Data

US 2020/0061441 A1 Feb. 27, 2020

Related U.S. Application Data

(63) Continuation of application No. 15/605,068, filed on May 25, 2017, now Pat. No. 10,463,945.

(51) Int. Cl.
*A63B 71/12* (2006.01)
*A41D 13/05* (2006.01)

(52) U.S. Cl.
CPC ..... *A63B 71/1225* (2013.01); *A41D 13/0543* (2013.01); *A63B 2071/1258* (2013.01)

(58) Field of Classification Search
CPC .. A41D 13/0543; A63B 71/12; A63B 71/1225
See application file for complete search history.

(56) References Cited

U.S. PATENT DOCUMENTS

| | | | | |
|---|---|---|---|---|
| 3,465,364 | A * | 9/1969 | Edelson | A63B 71/1225 2/22 |
| 10,463,945 | B2 * | 11/2019 | Blunt | A63B 71/1225 |
| 2011/0113559 | A1 | 5/2011 | Dodd | |
| 2011/0239348 | A1 * | 10/2011 | Sandusky | B32B 27/065 2/22 |
| 2011/0252548 | A1 * | 10/2011 | Weiss | A41D 13/0556 2/455 |
| 2013/0232674 | A1 * | 9/2013 | Behrend | A41D 13/0543 2/455 |
| 2013/0234376 | A1 * | 9/2013 | Frey | A41D 13/015 267/141 |
| 2014/0259325 | A1 | 9/2014 | Behrend et al. | |

FOREIGN PATENT DOCUMENTS

| | | | |
|---|---|---|---|
| CN | 102316756 | A | 1/2012 |
| CN | 102395286 | A | 3/2012 |
| CN | 105188432 | A | 12/2015 |
| CN | 105188433 | A | 12/2015 |
| CN | 105579005 | A | 5/2016 |
| DE | 202007009262 | U1 | 9/2007 |
| EP | 1369149 | A1 | 12/2003 |
| FR | 3031037 | A1 | 7/2016 |

* cited by examiner

*Primary Examiner* — Katherine M Moran
(74) *Attorney, Agent, or Firm* — Quinn IP Law

(57) ABSTRACT

A shin guard includes a protective shell having a convex outer surface and a concave inner surface, a cushioning element abutting the inner surface, and a polymeric texture provided on the outer surface to inhibit the motion of an overlaid textile relative to the protective shell.

19 Claims, 5 Drawing Sheets

SHIN GUARD WITH SOCK ENGAGING FEATURE

CROSS REFERENCE TO RELATED APPLICATIONS

The present application is a continuation of U.S. patent application Ser. No. 15/605,068, issued as U.S. Pat. No. 10,463,945, which is incorporated by reference in its entirety.

TECHNICAL FIELD

The present disclosure relates generally to a shin guard with an outwardly facing feature for restricting motion of the guard relative to a wearer's clothing.

BACKGROUND

Protective padding, such as a shin guard, is commonly used in sporting to limit potential impact forces that may be experienced by an athlete. Such protective padding is intended to dissipate and attenuate any received impact forces as well as to resist a puncture or impalement.

Traditionally, shin guards are used by an athlete to protect the shin region of the athlete against any external impacts. Shin guards, in an as-worn position, generally extend from below the knee to a location superior of the ankle, and cover a portion of the wearer's tibia. The general size and shape of the protective portion of the shin guard, however, may vary by design.

During use, the wearer of the shin guard may place the shin guard against their shin and under a sock to secure the shin guard into a position. Additionally or alternatively, the shin guard may be used with one or more straps or sleeves to help secure the shin guard when worn. However, these methods of securing the shin guard may still allow the shin guard to shift or otherwise move out of position relative to a wearer's leg.

SUMMARY

A shin guard that maintains it's positioning relative to an overlaid textile, such as a sock, includes a protective shell having a convex outer surface and a concave inner surface, a cushioning element abutting the inner surface, and a polymeric texture provided on the outer surface. The polymeric texture includes a plurality of protrusions that each extend from the outer surface by a maximum distance of from about 1 mm to about 5 mm and that each have a hardness measured on the Shore A scale of from about 20 A to about 60 A.

In some embodiments, the polymeric texture may include a carrier layer. To facilitate manufacturing of the guard, each of the plurality of protrusions may be molded onto the carrier layer, and the carrier layer may then be adhered to the protective shell. In embodiments where the carrier material comprises a thin polymeric film or woven fabric, the plurality of protrusions may each extend from either the outer surface of the shell, or from the carrier layer by the maximum distance of from about 1 mm to about 5 mm. In some embodiments, the carrier layer may be a lattice structure that includes a plurality of connecting members, each extending between two adjacent protrusions.

In some embodiments, each of the plurality of protrusions may have a shape that is conical or pyramidal, and may further be spherically blunted to promote safety. Furthermore, in some embodiments, the protective shell may include a central region and a peripheral region that surrounds the central region. The area of the central region may be greater than about 50% of the area of the peripheral region, and the plurality of protrusions extend from the peripheral region.

Furthermore, in some embodiments, the plurality of protrusions may be a first plurality of protrusions, and may each have a generally common height. The polymeric texture may then include a second plurality of protrusions that have lesser heights and that provide a visual gradient effect. The second plurality of protrusions may exhibit less of a textile holding effect than the first plurality of protrusions. Likewise, the second plurality of protrusions may have a greater average spacing between adjacent protrusions than the average spacing of the first plurality of protrusions.

It is an aspect of the present design to provide a shin guard that minimizes the need for ancillary holding means (e.g., straps, sleeves, or athletic tape) to maintain the proper positioning of the guard. In an ideal configuration, the present guard may be placed between a user's skin and a surrounding sock, and may maintain position solely based on the holding strength and elasticity of the sock. In less ideal configurations, ancillary holding means may still be used, though sole reliance on them to ensure proper positioning may be diminished.

In an aspect of the present design, a texture provided on the outward-facing surface of a protective pad/guard may inhibit motion of an overlaid textile relative to the pad/guard. Such a design may be generally applicable to any personal protective padding that may be positioned under a wearer's outer clothing.

It is a further aspect of the present design to provide for the safety of the wearer and for others that may contact the protective pad/guard by designing the texture with sufficient compliance to not separately enhance a risk of injury.

The above features and advantages and other features and advantages of the present invention are readily apparent from the following detailed description of the best modes for carrying out the invention when taken in connection with the accompanying drawings.

DETAILED DESCRIPTION

Figure 1:
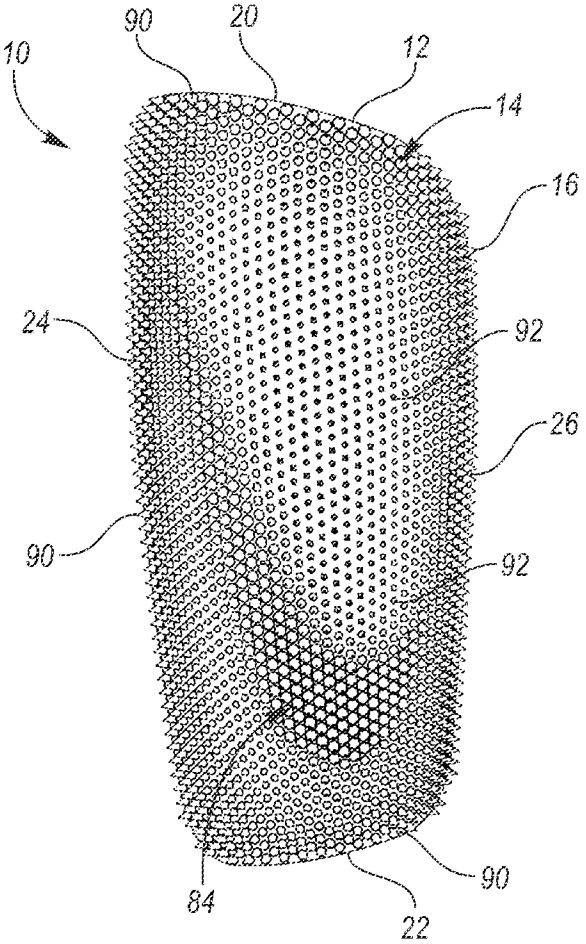
FIG. 1 is a schematic perspective side view of an embodiment of a shin guard with a sock engaging surface feature.

Referring to the drawings, wherein like reference numerals are used to identify like or identical components in the various views, FIG. 1 schematically illustrates a shin guard 10 that is operative to engage a wearer's sock to aid in maintaining the shin guard 10 in a desired position relative to a wearer's leg. The shin guard 10 includes a protective shell 12 and a functional polymeric texture 14 extending from the shell 12. The polymeric texture 14 includes a plurality of protrusions 16 that are dimensioned to impinge into a weave or knit of an overlaid textile, such as a sock, to inhibit relative motion between the shell 12 and the textile.

In general, the protective shell 12 has a top/superior edge 20, a bottom/inferior edge 22, a lateral edge 24, and a medial edge 26 opposite the lateral edge 24 (not visible as depicted). As better shown in the exploded perspective view of FIG. 2, the protective shell 12 curves from the medial edge 26 to the lateral edge 24 to form a convex outer surface 30 and an opposite, concave inner surface 32. The outer surface 30 is outward-facing relative to the wearer when in an as-worn position, and can generally face in an anterior direction. Typically, the outer surface 30 is the surface facing an incoming object for which the shin guard 10 is intended to provide protection. Conversely, the inner surface 32 is typically inward-facing when the shin guard 10 is in an as-worn position. As shown, the polymeric texture 14 is disposed on, and extends from the outer surface 30 of the protective shell 12.

The protective shell 12, is formed from a rigid or semi-rigid material that is effective to distribute an impact force across an area of the protective apparatus. Furthermore, the shell 12 should be formed from a material that is functional to resist a puncture force exerted by an object, such as an opposing athlete's shoe cleat(s). Suitable materials for manufacturing the shell 12 include, but are not limited to, polymers (e.g., ionomer resins, polypropylene, woven polypropylene, polyethylene, polystyrene, polyester, polycarbonate, polyamide, and the like), carbon fiber composites, metals (e.g., aluminum, titanium), natural materials (e.g., bamboo), and other materials.

Figure 2:
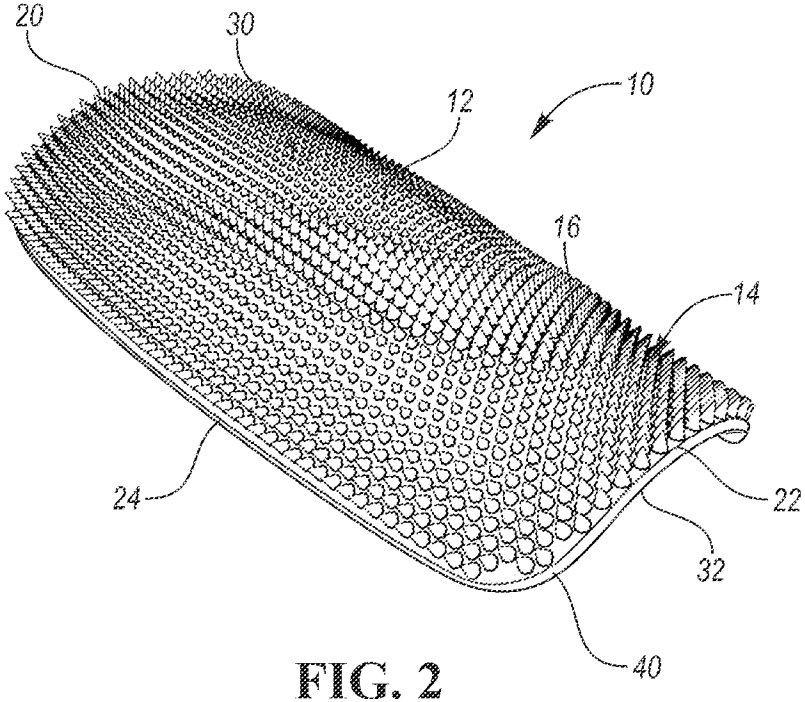
FIG. 2 is a schematic exploded side view of the shin guard of FIG. 1
Figure 3:
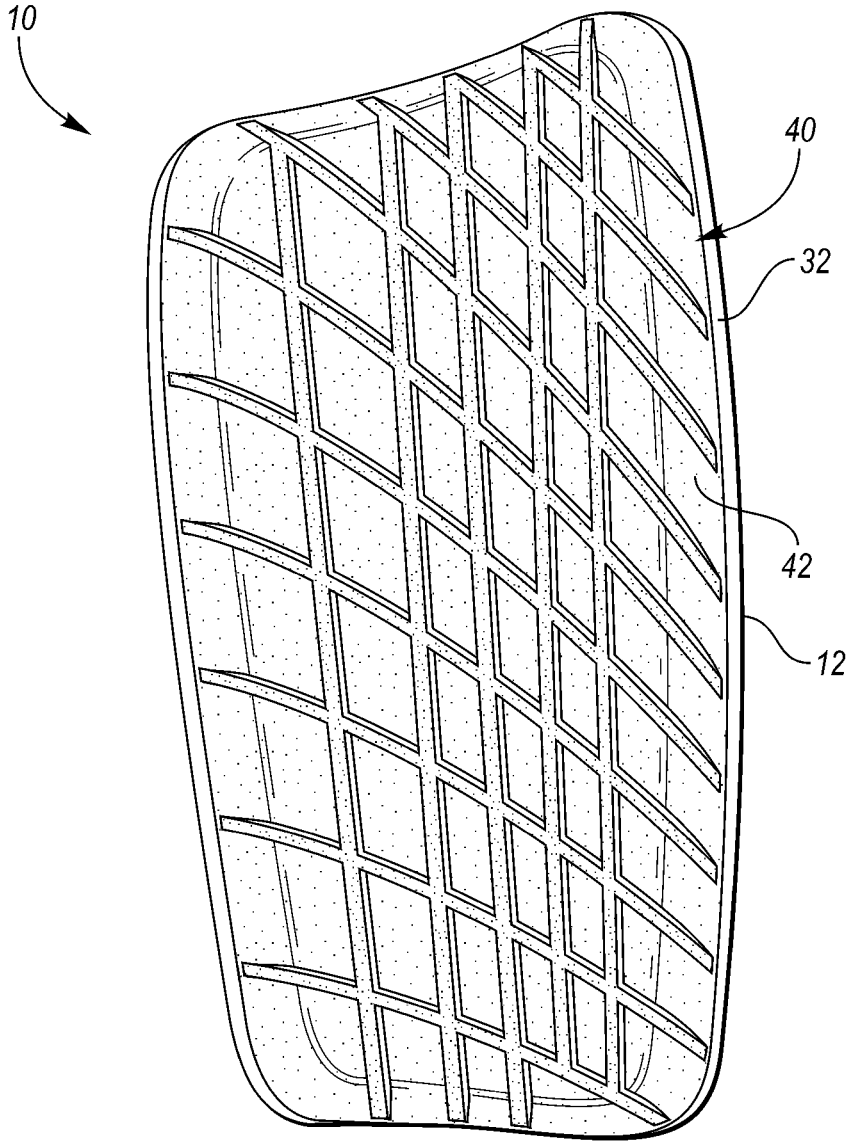
FIG. 3 is a schematic rear view of an embodiment of a cushioning element of a shin guard.
Figure 4:
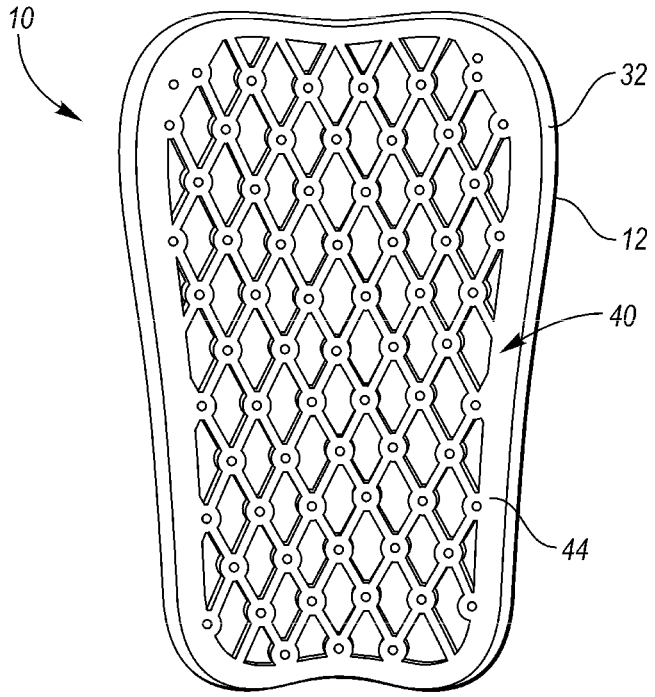
FIG. 4 is a schematic rear view of an embodiment of a cushioning element of a shin guard.

As further illustrated in FIGS. 2-4, the shin guard 10 includes a cushioning element 40 coupled to the protective shell 12 such that the cushioning element 40 abuts the inner surface 32. The cushioning element 40 serves the purpose of absorbing, dissipating, and/or distributing an impact load received by the protective shell 12 prior to any impact energy being transferred to the wearer. In general, the cushioning element is disposed between the protective shell 12 and the wearer's skin when the guard 10 is used.

In the embodiment illustrated in FIG. 3, the cushioning element 40 includes an impact-absorbing material 42, such as a foam, extending across at least a portion of the inner surface 32 of the protective shell 12. An example of such an embodiment is further described in U.S. Patent Publication No. 2016/0316827 (the '827 application), entitled "Protective Apparatus Having an Impact Attenuation Component," which is hereby incorporated by reference in its entirety. As discussed in the '827 application, the impact-absorbing material 42 may be, for example, an ethylene-vinyl acetate material, and may either directly abut the protective shell 12, or may abut the protective shell 12 through an intermediate standoff, such as a rib or lattice structure protruding from the inward surface 32 of the shell 12.

In the embodiment illustrated in FIG. 4, the cushioning element 40 includes an impact-absorbing structure 44 extending across at least a portion of the inner surface 32 of the protective shell 12. An example of such an embodiment is further described in U.S. Patent Publication No. 2013/0232674 (the '674 application), entitled "Protective Pad Using A Damping Component," which is hereby incorporated by reference in its entirety. As discussed in the '674 application, the impact-absorbing structure 44 may include a user-contacting layer 46 and a plurality of dampening members 48 (more clearly illustrated in FIGS. 5-6) extending between the user-contacting layer 46 and the protective shell 12. In one configuration, the user-contacting layer 46 may include a lattice-like structure that enables airflow/ventilation through the layer 46 and to the user. Likewise, the impact-absorbing structure 44 may be formed from, for example, a thermoplastic elastomer.

Figure 5:
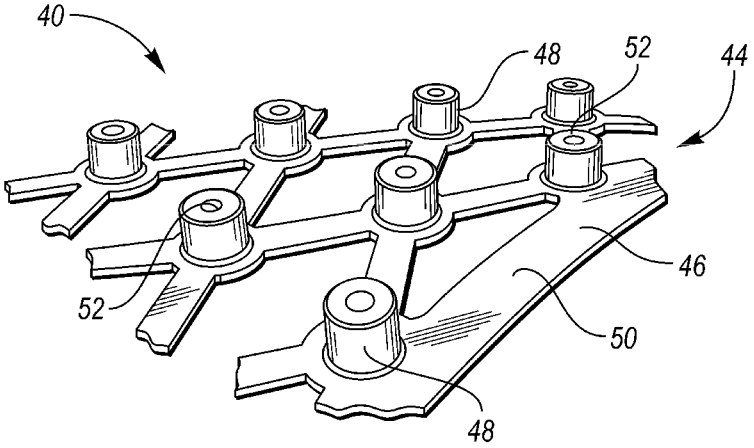
FIG. 5 is a schematic perspective view of the cushioning element of FIG. 4.
Figure 6:
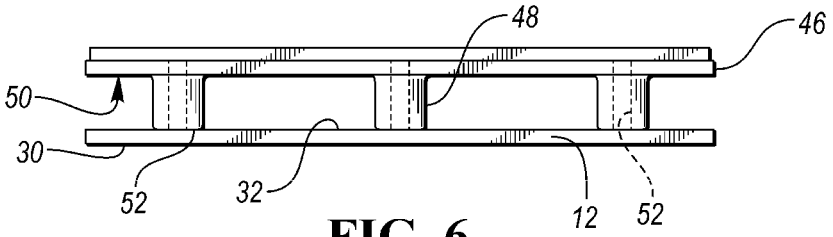
FIG. 6 is a schematic cross-sectional view of the cushioning element of FIG. 4.

As shown in FIGS. 5-6, in one embodiment, the plurality of dampening members 48 may extend from an outward-facing surface 50 of the user-contacting layer 46 outwardly toward the inner surface 32 of the protective shell 12. The dampening members 48 may each include a central void 52 extending through at least a portion of the respective dampening member 48, where the central void 52 may provide enhanced impact attenuation characteristics through the introduction of crumple zone-type functionality. For example, the inclusion of a void-like space provides an area in which a portion of the dampening member 48 may deform to absorb an impact force.

Figure 7:
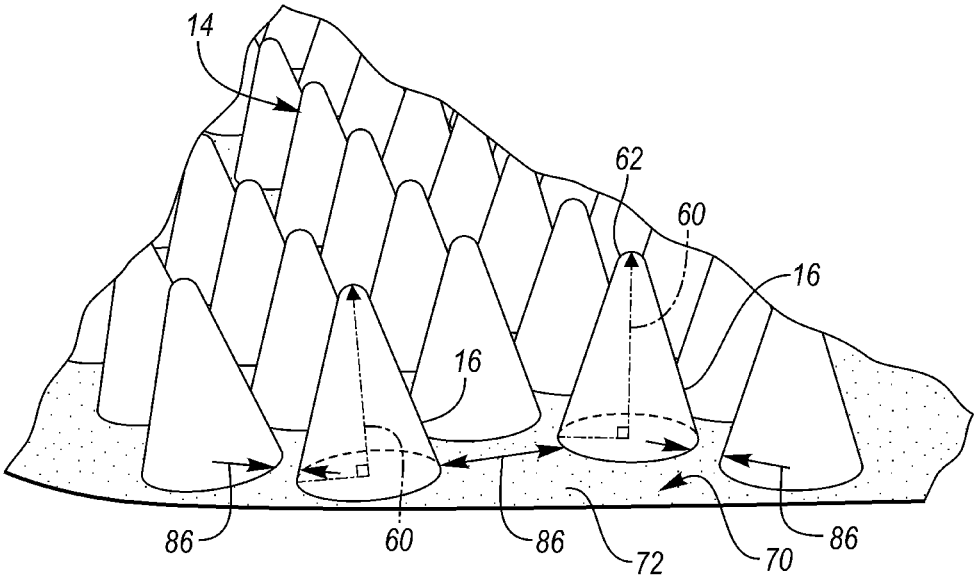
FIG. 7 is a schematic enlarged perspective view of a polymeric texture for engaging an overlaid textile.

Referring again to FIG. 1, the polymeric texture 14 should be particularly designed to engage with an overlaid woven or knit fabric/textile such that it inhibits any relative translation of the fabric across the outer surface 30. Due to the placement of the texture on the outer surface 30, it is also of critical importance for the texture 14 to not present any safety risks to other players. To accomplish these design objectives, it has been found that the protrusions 16 should extend/protrude from the outer surface 30 and/or from a surrounding land-area by a maximum distance 60 of from about 1 mm to about 5 mm (best shown in FIG. 7) and that each have a hardness measured on the Shore A scale of from about 20 A to about 60 A. In one particular embodiment, the maximum distance 60 may be about 3 mm, and the hardness may be about 50 A, measured on the Shore A scale. Furthermore, it is preferable for the protrusions to have a spherically blunted tip 62, such as also illustrated in FIG. 7. Likewise, in some embodiments, each of the plurality of protrusions 16 may have a shape that is either conical or pyramidal, and preferably with a height-to-base width aspect ratio of greater than about 1.0, or even greater than about 1.5.

As the respective protrusions 16 are likely made of a different material and have different material properties than the protective shell 12, manufacturing the guard may pose certain challenges. In a first embodiment, the texture 14 and/or protrusions 16 may be co-molded with the protective shell 12. In another embodiment, the texture 14 and/or protrusions 16 may be 3D printed directly onto the protective shell 12. In either case, to permit mold release and/or accurate 3D printing, the texture 14 may be fused to the shell 12 prior to the shell 12 being formed into its convex shape (such as shown in FIG. 2). In one configuration, the shell 12 may be formed into a convex shape through a forming process such as vacuum forming.

While direct affixment to the shell 12 may be a viable manufacturing method, accurately shaping the shell 12 with the affixed texture may present certain challenges. As such, in another embodiment, such as shown in FIG. 7, the polymeric texture 14 may include a carrier layer 70 that may facilitate attachment of the protrusions 16 to the shell 12.

The carrier layer 70 may be, for example, a polymeric film 72, such as a polyurethane film, or may include a woven fabric. The polymeric film 72 may be characterized by an average thickness of less than about 1.5 mm, and more preferably less than about 0.75 mm. In such an embodiment where the carrier layer is a thin film, the protrusions 16 may extend/protrude from the outer surface 30 and/or from the carrier layer 70 by a maximum distance 60 of from about 1 mm to about 5 mm. During manufacturing, the plurality of protrusions 16 may be molded onto the carrier layer 70, and the carrier layer 70 may subsequently be adhered to a fully formed protective shell 12.

Figure 8:
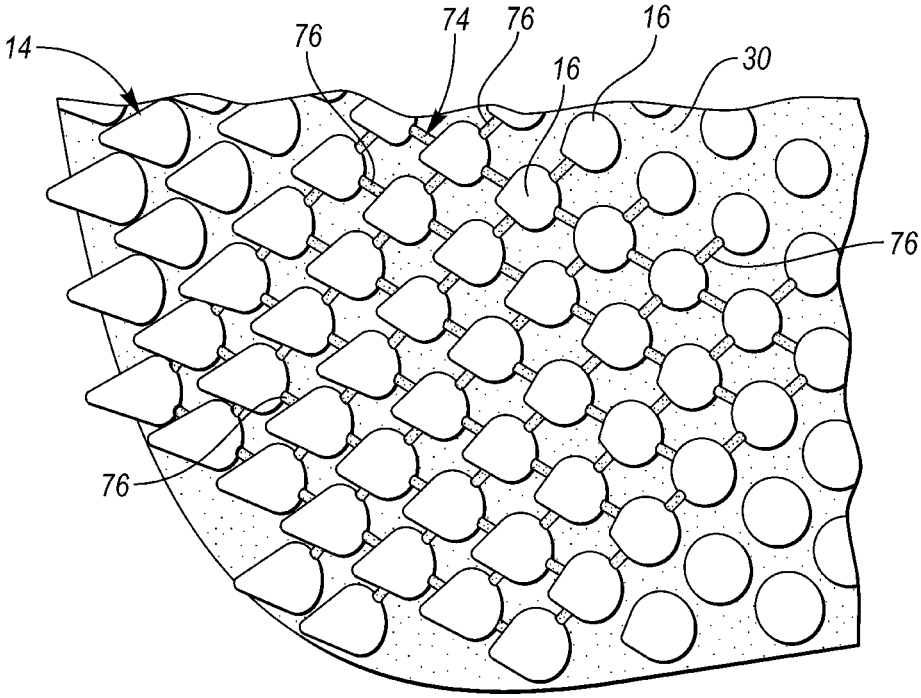
FIG. 8 is a schematic enlarged perspective side view of an embodiment of a polymeric texture for engaging an overlaid textile.

In yet another embodiment, such as shown in FIG. 8, the carrier layer 70 may include a lattice structure 74 that is formed from a plurality of discrete connecting members 76, each extending between two adjacent protrusions 16. In one configuration, the connecting members 76 may be integrally formed with and from the same material as the plurality of protrusions 16. Such a technique may have benefits in terms of manufacturability, though the connecting members 76 may obscure any graphics or graphic detail that is disposed directly on the polymeric shell 12 (i.e., whereas a polymeric film can be transparent to permit underlying graphics to be more visible without being obscured or distorted).

Figure 9:
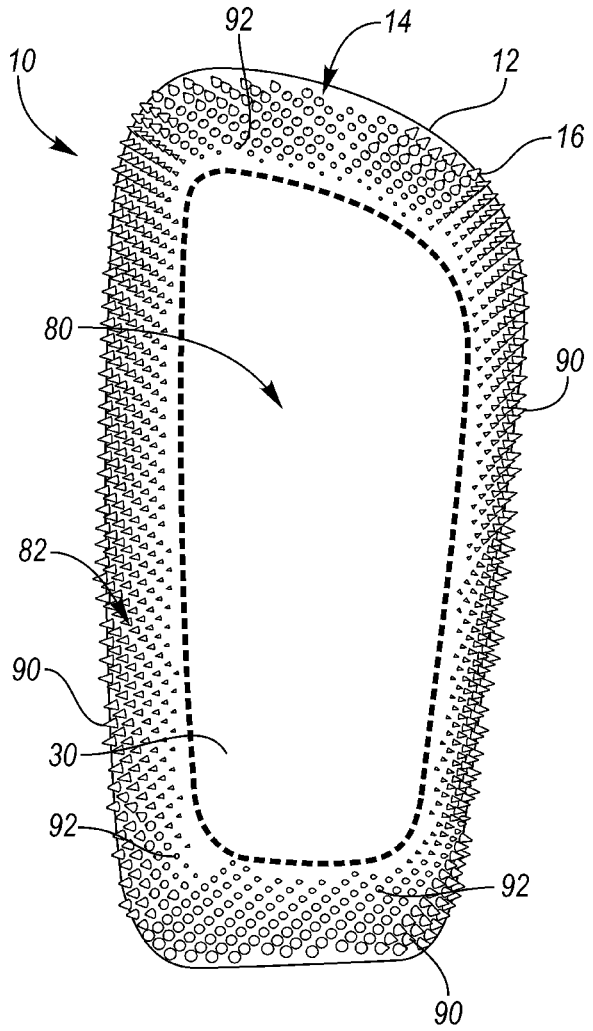
FIG. 9 is a schematic perspective side view of an embodiment of a shin guard with a sock engaging surface feature.

To establish adequate grip relative to an overlaid textile, such as a sock, it is preferable for the polymeric texture 14 to include at least 20 protrusions, and more preferably to include more than 50 protrusions. Likewise, it has been found that placement of the protrusions 16 close to an outer perimeter of the shell 12 provides the most robust means of inhibiting motion of an overlaid textile relative to the guard 10. For example, as illustrated in FIG. 9, the outer surface 30 of the protective shell 12 may generally be divided between a central region 80 and a peripheral region 82 that surrounds the central region 80. In one configuration, the protrusions 16 may be disposed entirely within the peripheral region 82. Furthermore, in some embodiments, the surface area of the protective shell 12 within the central region 80 may be greater than 50% of the surface area of the protective shell 12 within the peripheral region 82.

In some embodiments, such as generally shown in FIGS. 1, 2, 9, and 10, the plurality of protrusions 16 may include protrusions of different maximum heights. Likewise, the spacing between adjacent protrusions may be variable across the outer surface 30. By varying the maximum heights and protrusion spacing, different visual effects may be achieved. For example, the plurality of protrusions 16 may give the perception of a visual gradient (best illustrated in FIGS. 9 and 10), or a logo 84, as shown in FIG. 1.

Figure 10:
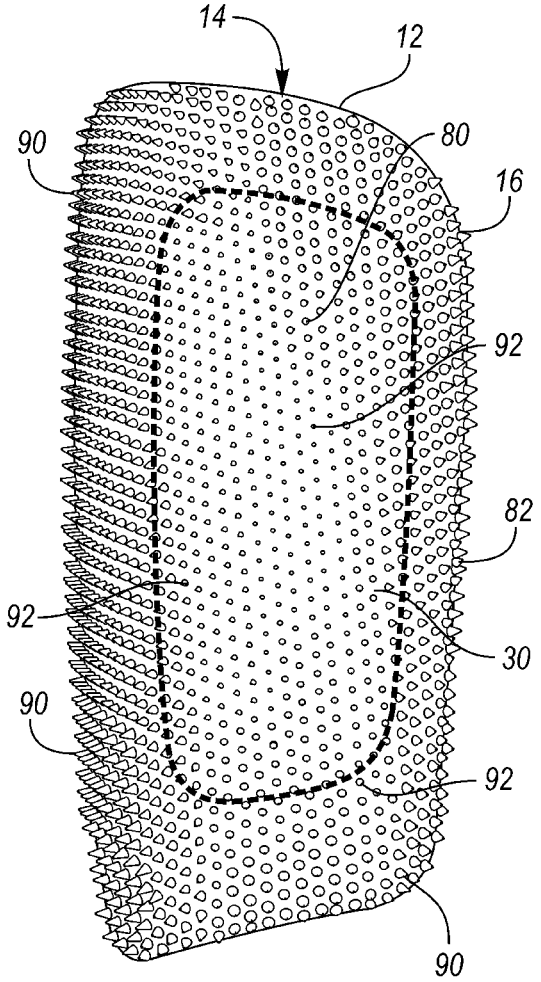
FIG. 10 is a schematic perspective side view of an embodiment of a shin guard with a sock engaging surface feature.

In some configurations, the polymeric texture 14 may include a first plurality of protrusions 90 that each extend from the outer surface by a common first maximum distance and/or have a common first average spacing 86 (generally illustrated in FIG. 7). The texture 14 may then further include a second plurality of protrusions 92 that each extend from the outer surface by a maximum distance that is less than the first common maximum distance and/or have an average spacing that is greater than the first average spacing. In such an embodiment, the first plurality of protrusions 90 may be the most visually pronounced, while the second plurality of protrusions 92 may effect a visual gradient or background. As best illustrated in FIGS. 9-10, in some configurations, the first plurality of protrusions 90 may be located within the peripheral region 82, while the second plurality of protrusions may be located within the peripheral region 82 and/or the central region 80. Likewise, in some configurations, the first common maximum distance may be the greatest maximum distance that any protrusion of the polymeric texture 14 extends from a surrounding land area or outer surface 30.

While the outside-in protrusion gradients illustrated in FIGS. 9 and 10 have proven to be the most effective in maintaining the position of the guard and/or for inhibiting motion of an overlaid textile, it is contemplated that other designs may be possible. For example, the gradient may be inside-out (i.e., where the largest, closest protrusions are at the most central region of the outer surface 30), top to bottom, bottom to top, outside-in from only the medial and lateral edges 26, 24, or any other visual arrangement.

While the present disclosure is made specifically with respect to shin guards, it is contemplated that the functional texture 14 may be useful with other protective pads to limit the motion of an outer garment/textile relative to the pad. For example, this texture 14 may be similarly applied to an external surface of American-Football shoulder pads, chest protectors, thigh protectors, or any other similar padding that is conventionally worn under the user's clothing.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A shin guard comprising:

a protective shell that includes a convex outer surface and a concave inner surface;

a cushioning element coupled to the protective shell such that the cushioning element abuts the inner surface; and a polymeric texture disposed on the outer surface, the polymeric texture including:

a first plurality of protrusions that each have a pyramidal, conical, or blunted conical shape and that each extend from the outer surface by a common maximum distance;

a second plurality of protrusions that each extend from the outer surface by a maximum distance that is less than the common maximum distance of the first plurality of protrusions.

2. The shin guard of claim 1, wherein the common maximum distance of the first plurality of protrusions is between about 1 mm and about 5 mm and that each have a hardness measured on the Shore A scale of from about 20A to about 60A.

3. The shin guard of claim 1, wherein the polymeric texture is operative to inhibit the relative translation of a woven or knit fabric across the outer surface.

4. The shin guard of claim 1, wherein the polymeric texture includes a carrier layer, and wherein each of the first plurality of protrusions are molded onto the carrier layer, and wherein the carrier layer is adhered to the protective shell.

5. The shin guard of claim 4, wherein the carrier layer is a polyurethane film or a woven fabric.

6. The shin guard of claim 4, wherein the carrier layer is a lattice structure comprising a plurality of connecting members, each connecting member extending between two adjacent protrusions.

7. The shin guard of claim 1, wherein the first plurality of protrusions includes more than 20 protrusions.

8. The shin guard of claim 7, wherein the first plurality of protrusions includes more than 50 protrusions.

9. The shin guard of claim 1, wherein the outer surface of the protective shell has a central region and a peripheral region surrounding the central region;

wherein an area of the central region is greater than 50% of an area of the peripheral region; and wherein the first plurality of protrusions extend from the peripheral region of the outer surface.

10. The shin guard of claim 9, wherein the second plurality of protrusions extend from one or both of the central region and the peripheral region of the outer surface.

11. The shin guard of claim 1, wherein the first plurality of protrusions has a first average spacing distance between adjacent protrusions;

wherein the second plurality of protrusions has a second average spacing distance between adjacent protrusions; and wherein the second average spacing distance is greater than the first average spacing distance.

12. A shin guard comprising:

a protective shell that includes a convex outer surface and a concave inner surface;

a cushioning element coupled to the protective shell such that the cushioning element abuts the inner surface; and a polymeric texture disposed on the outer surface, the polymeric texture including:

a first plurality of protrusions, each having a pyramidal, conical, or blunted conical shape and extending from the outer surface by a common maximum distance, and wherein the first plurality of protrusions has a first average spacing distance between adjacent protrusions;

a second plurality of protrusions extending from the outer surface, the second plurality of protrusions has a second average spacing distance between adjacent protrusions; and wherein the first average spacing distance is different than the second average spacing distance.

13. The shin guard of claim 12, wherein the second plurality of protrusions extend from the outer surface by a maximum distance that is less than the common maximum distance of the first plurality of protrusions.

14. The shin guard of claim 13, wherein the second average spacing distance is greater than the first average spacing distance.

15. The shin guard of claim 12, wherein the common maximum distance of the first plurality of protrusions is between about 1 mm and about 5 mm and that each have a hardness measured on the Shore A scale of from about 20A to about 60A.

16. The shin guard of claim 12, wherein the polymeric texture is operative to inhibit the relative translation of a woven or knit fabric across the outer surface.

17. The shin guard of claim 12, wherein the polymeric texture includes a carrier layer, and wherein each of the first plurality of protrusions are molded onto the carrier layer, and wherein the carrier layer is adhered to the protective shell.

18. The shin guard of claim 12, wherein the outer surface of the protective shell has a central region and a peripheral region surrounding the central region;

wherein an area of the central region is greater than 50% of an area of the peripheral region; and wherein the first plurality of protrusions extend from the peripheral region of the outer surface.

19. The shin guard of claim 18, wherein the second plurality of protrusions extend from one or both of the central region and the peripheral region of the outer surface.

* * * * *